United States Patent [19]

Arnold

[11] Patent Number: 4,457,085

[45] **Date of Patent: * Jul. 3, 1984**

[54] EXCAVATING BUCKETS

[75] Inventor: Carroll H. Arnold, Westminster, Mass.

[73] Assignee: Wain-Roy, Inc., Hubbardston, Mass.

[ * ] Notice: The portion of the term of this patent subsequent to Jul. 21, 1998 has been disclaimed.

[21] Appl. No.: 445,152

[22] Filed: Nov. 29, 1982

Related U.S. Application Data

[63] Continuation of Ser. No. 238,801, Feb. 27, 1981, abandoned, which is a continuation-in-part of Ser. No. 129,489, Mar. 10, 1980, Pat. No. 4,279,085.

[51] Int. Cl.[3] ..... E02F 3/76

[52] U.S. Cl. ..... 37/103; 37/117.5; 37/DIG. 3; 37/141 R; 172/699

[58] Field of Search ..... 37/117.5, 103, DIG. 3, 37/118, 141 T, 141 R; 172/699

[56] References Cited

U.S. PATENT DOCUMENTS

| | | | |
|---|---|---|---|
| 740,165 | 9/1903 | Musso | 37/118 R |
| 2,660,323 | 11/1953 | Carlesimo | 37/141 T |
| 3,471,950 | 10/1969 | Ferwerda | 37/103 X |
| 3,724,899 | 4/1973 | Clark | 37/117.5 X |
| 3,767,070 | 10/1973 | Arnold | 37/117.5 X |
| 3,854,608 | 10/1973 | Arnold | 37/117.5 X |
| 4,037,337 | 7/1977 | Hemphill | 37/141 T X |
| 4,038,766 | 8/1977 | Felstet | 37/117.5 X |
| 4,041,624 | 8/1977 | Fryrear | 37/117.5 |
| 4,204,348 | 5/1980 | Lydie | 37/117.5 |
| 4,279,085 | 7/1981 | Arnold | 37/103 |

FOREIGN PATENT DOCUMENTS

| | | | |
|---|---|---|---|
| 596392 | 3/1978 | Switzerland | 37/103 |
| 200004 | 7/1923 | United Kingdom | 37/141 T |
| 306228 | 9/1971 | U.S.S.R. | 37/141 R |
| 610929 | 5/1978 | U.S.S.R. | 37/DIG. 3 |
| 682605 | 8/1979 | U.S.S.R. | 37/141 T |

OTHER PUBLICATIONS

"Backhoe Bucket Ripper", H & L Tooth Company Sales Manual, Data Section 12, Mar. 1971, p. RH-1, p. 7.

*Primary Examiner*—E. H. Eickholt

[57] ABSTRACT

An excavating device having a plurality of gouging members protruding downwardly from the bottom of an excavating bucket, and extending therefrom in the direction toward the bucket's scooping edge, the members being staggered at varying distances from the edge and bucket sides.

23 Claims, 9 Drawing Figures

FIG. 1
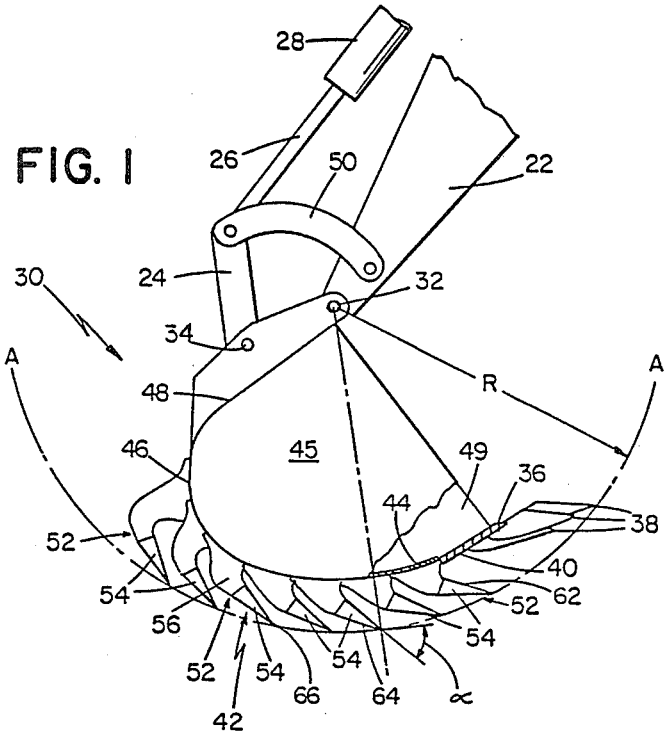
FIG 2
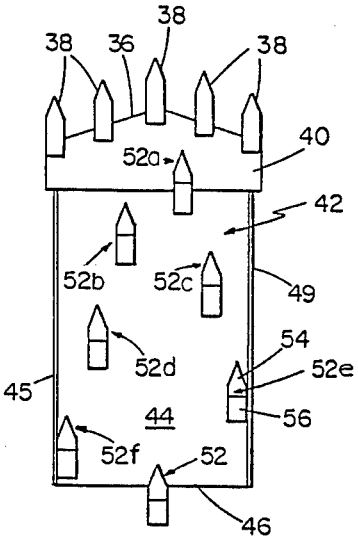
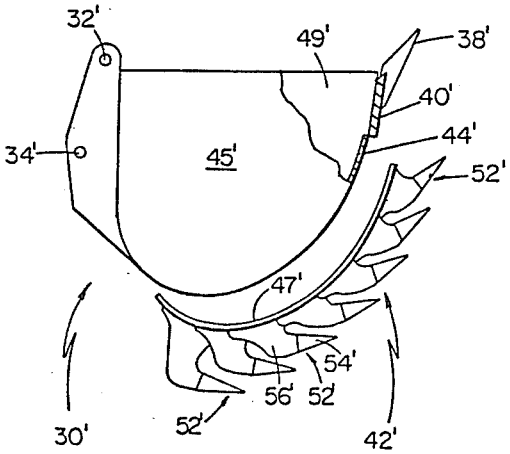
FIG 3
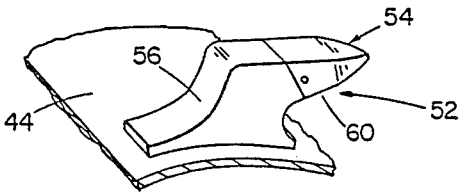
FIG 4
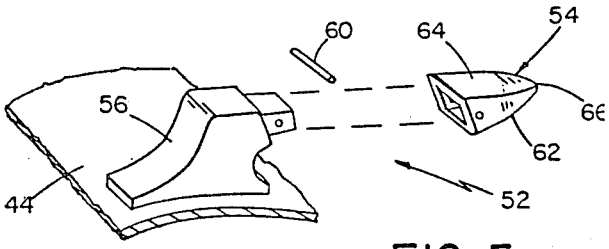
FIG 5

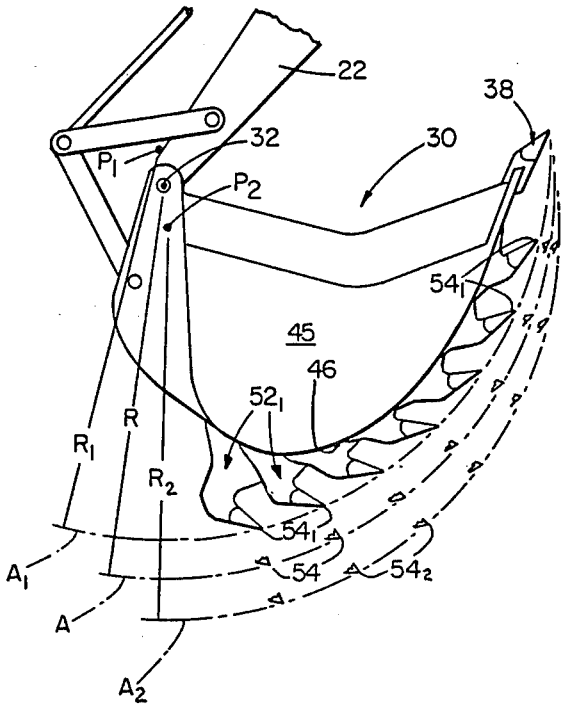
FIG 6
FIG 7
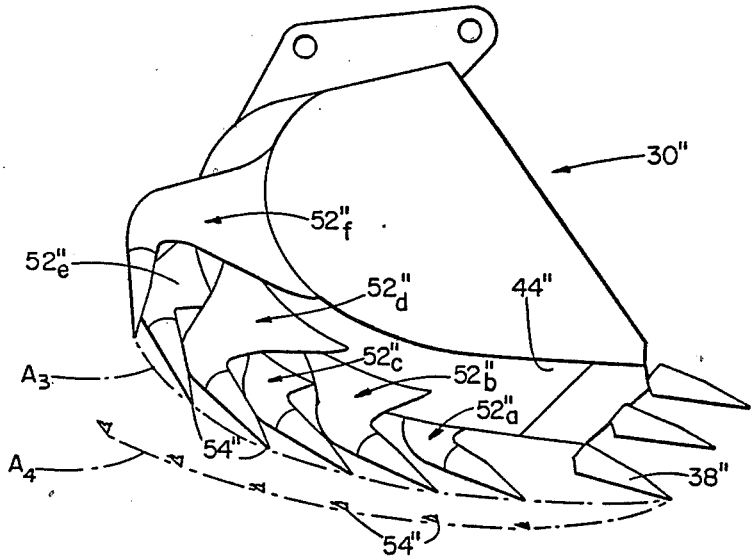
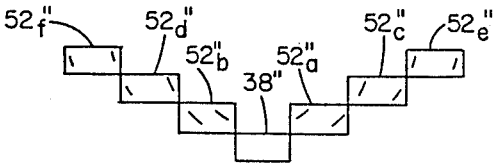
FIG 8A
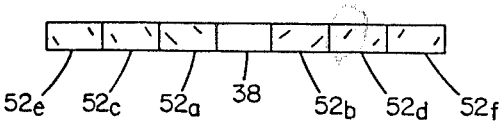
FIG 8B

EXCAVATING BUCKETS

CROSS-REFERENCE TO RELATED APPLICATIONS

This application is a continuation of application Ser. No. 238,801, filed Feb. 27, 1981, now abandoned which is a continuation-in-part of application Ser. No. 129,489 filed Mar. 10, 1980 and now U.S. Pat. No. 4,279,085 issued July 21, 1981.

BACKGROUND OF THE INVENTION

This invention relates to excavating buckets.

Excavating buckets, such as those used on apparatus commonly known as a backhoe, are usually pivotally attached to a movable dipperstick, with separate actuators arranged to power bucket pivoting and dipperstick movements, respectively. Such buckets often have teeth-like protrusions along a leading edge which loosen and scoop material as the bucket moves through the substrate to be excavated; and may also include a row of ripper teeth attached to the rear of the bucket (i.e., on the side opposite the leading edge) generally parallel to the leading edge and perpendicular to the direction of the motion of the bucket for dislodging and breaking up tightly compacted substrate. Such ripper teeth are usually arranged to operate with the bucket actuator fixed in a fully extended position, and the ripping motion is powered by the dipperstick actuator.

Such ripper teeth have not been entirely satisfactory. They often penetrate too deeply and tend to "stall out" the dipperstick cylinder. Additionally, the material loosened has a tendency to jam the motion of the bucket and cause it to ride over the material and thus reduce ripping penetration; and efficiency of operation is hindered by the need constantly to reposition the bucket to maintain the proper ripper tooth cutting angle.

It is an object of the present invention to maximize ripping effectiveness while at the same time overcoming the above limitations.

SUMMARY OF THE INVENTION

I have discovered that, by providing a plurality of rippers which protrude downwardly from the bottom (either V-shaped or flat) of an excavating bucket and face towards its front edge, the rippers being staggered from the front edge to the back of the bucket at varying distances from the bucket sides, powered movement of the bucket through a substrate will dislodge pieces without generating drag to stall the bucket's movement. The rippers can be permanently fixed to the bucket bottom or can be part of an adapter which itself may be attached to a bucket.

In preferred embodiments the rippers are not aligned with each other either transversely or longitudinally of the bucket, but are spaced front to rear in a V-pattern. The forward edges of the rippers may all lie on a constant radius measured from the axis of pivotal connection of the bucket to the dipperstick (or, as may sometimes be preferred or from a point above or below the axis of pivotal connector), or may lie on an elliptical arc tailing in towards or away from the bucket bottom. The lead ripper may be positioned either on or behind the bucket front edge; the ripper pattern may be such that each ripper fractures material into the grooves cut by the preceding ripper; all rippers are designed to maintain the optimum cutting angle (generally 35°–55° and, preferably, 45°); and for any ripper the clearance between its teeth and the bottom of bucket is greater than in the case of the rippers forward of it.

DESCRIPTION OF THE PREFERRED EMBODIMENT

We turn now to the preferred embodiments of the invention, first briefly describing the drawings.

FIG. 1 is a side elevation of the bucket, partly broken away.

FIG. 2 is a bottom view of the bucket of FIG. 1.

FIG. 3 is a side elevation of a bucket and attachment therefore, showing another embodiment of the invention.

FIGS. 4 and 5 are detailed views of a ripper used in either of the embodiments of FIG. 1 or FIG. 3.

FIG. 6 is a side elevation of the bucket of FIG. 1, showing variations in ripper radius.

FIG. 7 is a side elevation of a V-bottom bucket embodying the invention.

FIGS. 8A and 8B are schematics showing ripper placement.

STRUCTURE

As shown in FIGS. 1 and 2, backhoe bucket 30 is attached to dipperstick 22 with hinge pin 32 and to link member 24 with hinge pin 34. Piston rod 26 connects hydraulic actuator 28 to link member 24, and link 50 connects member 24 and dipperstick 22. Leading or scooping edge 36 of bucket 30 has five forwardly disposed teeth 38, extending from forward-pointing, "V"-shaped cutting plate 40.

Bucket 30 has curved bottom plate 42, connecting two side walls 45 and 49 and forming both the bottom 44 and back 46 of the bucket, and a top plate 48. Seven rippers 52 are attached to bottom plate 42, staggered at regular intervals from bucket scooping edge 36 to the rear of plate 42. The forward six of ripper 52 are arranged in a V-configuration, with the center one of teeth 38 on edge 36 forming the apex of the V, and the rippers 52 at the rear of the V close to the bucket sides. The rear most ripper 52 is not part of the V, but is aligned with center tooth 38. As shown in FIG. 2, no two rippers 52 are aligned with each other, either from side-to-side or from front to back of bucket 30. Also, as shown in FIG. 1, the clearance between each ripper 52 and the bottom 44 of the bucket progressively increases from front to rear of the bucket.

Referring now to FIGS. 4 and 5, each ripper 52 includes a shank 56 fixed to the bucket bottom 44, and a ripper tooth 54 fitted over the end of the shank and held in place by a pin 60.

Each tooth 54 includes relatively inclined upper and lower surfaces, 62, 64 respectively, which set in a point 66 at the front of the tooth. The points 66 of all of rippers 52 are equidistant from the hinge pin 32 about which bucket 30 rotates relative to dipperstick 22, as illustrated by arc A of radius R. As shown, the center one of teeth 38 also lies on arc A. The upper surface 62 of each tooth 54 defines the tooth cutting angle, a, which, for each of rippers 52, is between about 35° and 55° and, preferably, 45°. The lower surface 64 is positioned so that it will not bottom-out in the trench cut by the tooth as the bucket is pivoted about hinge pin 32. The progressively greater clearance (front to rear) between the ripper and bucket bottom 42 is provided by, as shown, a progressive increase in the length of shanks 56.

FIG. 3 shows an alternative embodiment of the invention in which plate 47′ is welded or bolted to the bottom digging surface 44′ of bucket 30′. Rippers 52′ are attached to plate 47′ and are identical to the rippers 52 of bucket 30. Depending on the curvature of surface 44′ of a particular bucket, the arc corresponding to A may not necessarily have a constant radius; however, the arrangement of progressively longer shanks and staggering of teeth with respect to edge 36 and the bucket sidewalls remains the same.

FIG. 6 illustrates the effect of mounting rippers 52 on a constant radius measured from a point that is above ($P_1$) or below ($P_2$), rather than coincident with, hinge pin 32. As shown, mounting the rippers on a constant radius $R_1$, measured from $P_1$ causes the arc A, on which the teeth 54, lie to tail in towards the bucket bottom 46 so that, as bucket 30 is rolled about hinge pin 32, the rippers pull away from the ground. With rippers so mounted, an operator would drop boom 22 as the bucket is rolled to maintain contact between the rippers and the ground.

Similarly, mounting the rippers on a constant radius $R_2$ measured from $P_2$ causes the arc $A_2$ on which teeth $54_2$ lie to tail away from the bucket bottom 44, and the rippers will engage the ground more aggressively as bucket 30 is rolled about hinge pin 32.

FIG. 7 shows a bucket 30″ having a V-shaped bottom 44″. Rippers 52″ are attached to bottom 44″ and are identical to the rippers 52 of bucket 30. Viewed from the side, the arc $A_3$ on which the points 54″ of rippers 52″ lie elliptical and, like arc $A_1$ of FIG. 6, tails in towards the bucket bottom. If desired, the rippers may also be positioned so that teeth 54″ lie on an elliptical arc $A_4$ which, like arc $A_2$ of FIG. 6, tails away from the bucket bottom. Such elliptical arcs may be provided on either V-bottom buckets (as shown) or on flat-bottom buckets such as those shown in FIGS. 1 and 6.

Referring now to FIGS. 2 and 8-B, the center tooth 38 and rippers $52_a$–$52_f$ forming the "V" configuration earlier referred to are of such width and are so placed that, as bucket 30 is rolled, successive teeth fracture substrate into the groove cut by preceding teeth and leave a cut having flat continuous bottom.

Teeth such as those provided on the V-bottom bucket of FIG. 7 may similarly be mounted, as shown in FIG. 8-A, so that each trailing tooth fractures substrate into the groove cut by a preceeding tooth and the teeth forming the "V" configuration (as shown the center leading edge tooth 38″ and six following rippers 52″) makes cuts extending substantially continuously the bucket width.

Operation

Actuator 28 (the bucket cylinder) pivots the bucket about hinge pin 32 (the bucket's axis of attachment to dipperstick 22) causing the bucket to scoop loose substate with the scooping edge and teeth and to rip compact substrate with the rippers 52. It is also possible to rip by moving dipperstick 22, but much greater force is generally available from extending the bucket cylinder.

Because rippers 52 are not transversely aligned, they sequentially engage the substrate, permitting each tooth to provide the maximum digging force. The side-to-side staggering of the rippers prevents rocks, frozen earth, etc. from being trapped between adjacent teeth, and the progressively increasing clearance between the rippers and the bucket bottom provides room for material loosened by forward teeth to pass between more rearward teeth and the bucket bottom without forcing the bucket up off the substrate which would disengage the more rearward teeth. The preferred "V" configuration (front-to-rear) ripper pattern allows a trailing tooth to fracture the substrate into the groove already cut by a preceding tooth. As shown in FIGS. 2, 7 and 8-A and 8-B, the center lead tooth 38, 38″ in the "V" makes the initial cut, ripper $52_a$, $52''_a$ fractures material from one side into the groove cut by tooth 38, 38″, ripper $52_b$, $52''_b$, fractures material from the other side into the groove cut by tooth 38, 38″ ripper $52_c$, $52''_c$ fractures material from the first side into the groove cut by tooth $52_a$, $52''_a$ and so forth. The width and placement of the center tooth 38 and the rippers 52 are such that, as shown in FIGS. 8-A and 8-B, the successive grooves they cut will essentially abut and span the entire bucket width. As the bucket 30 is pivoted about hinge pin 32, each tooth cuts at the optimum cutting angle, without requiring adjustment or change in the position of the dipperstick.

The sequential ripping of teeth 54 is at controlled depths, and since all teeth are on a constant radius from the pivot point, the flat bottom buckets of FIGS. 1, 2 and 6 cut a flat-bottom trench automatically.

Other Embodiments

In other embodiments the rippers can be arranged in staggered patterns, i.e., patterns in which they do not align transversely or longitudinally, other than the front-to-rear "V"; the rippers may be bolted in place; the front edge of the bucket can be straight rather than "V" shaped; the teeth on the front edge can have other configurations such as flat or bifuracted; or, the front edge may be straight cutting edge and the leading ripper may lie behind the front edge and be mounted on the bucket bottom.

In still further embodiments, as noted with respect to FIG. 3, the radius on which the teeth are mounted may increase or decrease from front to rear of the bucket rather than remaining constant.

These and other embodiments will be within the scope of the following claims.

What is claimed is:

1. In an excavating bucket including two sides and a curved bottom connecting said sides, said bottom having a front scooping edge, and a plurality of rippers protruding downwardly from said bottom and facing towards said scooping edge, said rippers being staggered at varying distances from said edge towards the back of said bucket and at varying distances from the sides of said bucket, that improvement wherein each of said rippers defines a cutting edge and said rippers are positioned such that said ripper cutting edges lie in an arc.

2. The bucket of claim 1 wherein said rippers are arranged in a V-configuration and the said ripper defining the apex of said V is mounted at said scooping edge.

3. The bucket of claim 1 including means defining the axis of rotation of said bucket relative to said dipperstick when said bucket is attached to said dipperstick, and wherein said arc is an arc of constant radius having its center at a point either above or below said axis of rotation.

4. The bucket of claim 1 wherein said arc is of constant radius.

5. The bucket of claim 1 wherein said arc is elliptical.

6. The bucket of claim 1 wherein the distance from said arc to means defining the axis of rotation of said bucket relative to a dipperstick when said bucket is attached to said dipperstick is greater adjacent the front of said bucket than towards the rear of said bucket.

7. The bucket of claim 1 wherein the distance from said arc to means defining the axis of rotation of said bucket relative to a dipperstick when said bucket is attached to said dipperstick is less adjacent the front of said bucket than towards the rear of said bucket.

8. The bucket of claim 1 wherein said rippers are attached to a mounting plate, and said mounting plate is attached to the bottom of said bucket.

9. The bucket of claim 1 wherein said bottom is flat.

10. The bucket of claim 1 wherein said bottom is V-shaped.

11. The device of claim 1 wherein the width and placement of said rippers is such that when viewed longitudinally of said bucket they extend transversely substantially continuously the width of said bucket.

12. The bucket of claim 1 wherein said arc has its center at a point above or below said axis of rotation.

13. For connection to an excavating bucket of the type including two sides and a curved bottom connecting said sides, a mounting plate adapted for connection to the bottom of said bucket, and a plurality of rippers protruding downwardly from said plate and facing towards a leading edge thereof, said rippers being staggered at varying distances from the leading edge of said plate towards the trailing edge of said plate and at varying distances from the sides of said plate, and being arranged such that at least the majority of said rippers do not align with each other either transversely or longitudinally of said plate.

14. The device of claim 13 wherein no two of said rippers are aligned either transversely or longitudinally of said plate.

15. The device of claim 13 wherein said rippers are arranged in a V-configuration.

16. The device of claim 13 including not less than six of said rippers, at least three of said rippers lying on each side of the longitudinal center line of said bucket.

17. The device of claim 13 wherein each of said rippers defines a cutting edge generally facing the forward edge of said device and wherein for each of said rippers the distance from the cutting edge thereof to said plate is greater than the corresponding distance for any ripper more closely adjacent said forward edge.

18. The device of claim 13 wherein said plate is flat.

19. The device of claim 13 wherein the width and placement of said rippers is such that when viewed longitudinally of said plate they extend substantially continuously the width of said plate.

20. In an excavating bucket including two sides and a curved bottom connecting said sides and having a front scooping edge, that improvement comprising:

a plurality of rippers protruding downwardly from the bottom and facing towards the scooping edge, said rippers being staggered at varying distances from said scooping edge towards the back of said bucket and at varying distances from the sides of the bucket and being so disposed that the majority of said rippers do not align with one another either transversely or longitudinally of the bucket, each of said rippers defining a cutting edge, and said rippers being so positioned such that said ripper cutting edges lie on an arc.

21. In an excavating bucket including:

two sides;

a bottom connecting said sides, having a front scooping edge and being curved from said front scooping edge towards the back of said bucket;

means defining the axis of rotation of said bucket relative to a boom or dipperstick to which said bucket may be attached; and a plurality of rippers protruding downwardly from said bottom and facing generally towards the front of said bucket, said rippers being positioned at varying distances from said front scooping edge such that when said bucket is rotated about said axis of rotation thereof said rippers will sequentially engage a substrate to be fractured, each of said rippers being arranged to engage the ground subsequent to any ripper more closely adjacent said front scooping edge and prior to any ripper farther from said front scooping edge, and said rippers being positioned at varying distances from the sides of said bucket such that when said bucket is rotated about said axis of rotation thereof rippers farther from said front scooping edge will fracture material of said substrate into cuts previously made by rippers nearer to said front scooping edge.

22. The device of claim 21 wherein each of said rippers defines a cutting edge, and said rippers are positioned such that said ripper cutting edges thereof lie in an arc.

23. The bucket of claim 21 wherein said rippers are arranged in a V-configuration, and including a ripper defining the apex of said V and mounted adjacent said scooping edge.

* * * * *